US005699628A

United States Patent [19]

Boatwalla

[11] Patent Number: 5,699,628

[45] Date of Patent: Dec. 23, 1997

[54] FOOTWEAR SYSTEM FOR USE IN DRIVING

[75] Inventor: Cyrus D. Boatwalla, New Canaan, Conn.

[73] Assignee: H.H. Brown Shoe Company, Inc., Greenwich, Conn.

[21] Appl. No.: 767,816

[22] Filed: Dec. 17, 1996

[51] Int. Cl.[6] ..... A43C 15/00

[52] U.S. Cl. ..... 36/59 C; 36/59 R

[58] Field of Search ..... 36/59 C, 59 R

[56] References Cited

U.S. PATENT DOCUMENTS

| | | | |
|---|---|---|---|
| 1,988,784 | 1/1935 | Carrier | 36/59 C |
| 2,205,912 | 6/1940 | Snyder | 36/59 C |
| 2,289,016 | 7/1942 | Jenco | 36/59 C X |
| 2,408,152 | 9/1946 | Porcelli . | |
| 2,408,214 | 9/1946 | Husted | 36/59 C |
| 3,169,327 | 2/1965 | Fukuoka | 36/72 R X |
| 3,258,863 | 7/1966 | Paget . | |
| 4,249,321 | 2/1981 | Nagy . | |
| 4,281,467 | 8/1981 | Anderie | 36/59 C X |
| 4,299,037 | 11/1981 | Carey . | |
| 4,441,264 | 4/1984 | Hantz-Guibas et al. . | |
| 4,559,723 | 12/1985 | Hamy et al. | 36/59 C |
| 4,571,852 | 2/1986 | Lamarche et al. . | |
| 4,660,301 | 4/1987 | Atwood . | |
| 4,702,021 | 10/1987 | Cameron . | |
| 4,724,624 | 2/1988 | Duclos | 36/59 R X |
| 4,727,659 | 3/1988 | Walker . | |
| 4,750,278 | 6/1988 | Cates . | |
| 4,777,738 | 10/1988 | Giese et al. | 36/59 C X |
| 4,794,705 | 1/1989 | Sanders . | |
| 4,872,271 | 10/1989 | Allen . | |
| 4,924,608 | 5/1990 | Mogonye . | |
| 5,012,597 | 5/1991 | Thomasson | 36/59 R X |
| 5,257,469 | 11/1993 | Beasley . | |
| 5,357,694 | 10/1994 | Mauck . | |
| 5,361,517 | 11/1994 | Liener . | |
| 5,423,135 | 6/1995 | Poole et al. | 36/59 R X |
| 5,485,687 | 1/1996 | Rohde . | |
| 5,507,105 | 4/1996 | Cancel . | |

*Primary Examiner*—Ted Kavanaugh
*Attorney, Agent, or Firm*—Fish & Richardson P.C.

[57] ABSTRACT

A footwear system for use in driving a vehicle includes a first boot or shoe and a second boot or shoe, each including a sole having a heel region at a proximal end of the sole with rounded ridges disposed adjacent to one another and extending substantially across a width of the sole. The sole of the first boot or shoe includes a first metatarsal region including rounded ridges disposed adjacent to one another and extending substantially along a length of the sole and the sole of the second boot or shoe includes a second metatarsal region having rounded ridges disposed adjacent to one another and extending substantially across a width of the sole.

6 Claims, 3 Drawing Sheets

FOOTWEAR SYSTEM FOR USE IN DRIVING

BACKGROUND OF THE INVENTION

The invention relates to footwear.

In many parts of the world, the population has become increasingly mobile, with more vehicles driven on the world's roadways and people spending ever greater amounts of time driving their vehicles. As evidenced by "rush hour" traffic problems which congest populated areas on a daily basis, a significant number of the drivers using the roadways are either travelling to and from work or are using their vehicles as part of their work (e.g., bus drivers, commercial truck drivers). In many cases, the shoes worn by these drivers are ill-suited for driving. Shoes which are appropriate in an office setting, where fashion and aesthetics are paramount, may be poorly suited for operating the control pedals (i.e., accelerator, brake and clutch) of a vehicle.

SUMMARY OF THE INVENTION

According to one aspect of the invention, a footwear system for use in driving a vehicle comprises a first boot or shoe and a second boot or shoe, each including a sole and an upper, the sole and upper together defining a volume for receiving a foot of a wearer. Each sole has a toe region at a distal end of the sole, a heel region at a proximal end of the sole with a first plurality of rounded ridges disposed adjacent to one another and extending substantially across a width of the sole. The sole of the first boot or shoe includes a first metatarsal region disposed substantially between toe and heel regions and along an inner side of the sole, the first metatarsal region including a second plurality of rounded ridges disposed adjacent to one another and extending substantially along a length of the sole. The sole of the second boot or shoe includes a second metatarsal region disposed substantially between toe and heel regions and along an inner side of the sole, the second metatarsal region disposed substantially between toe and heel regions and along an inner side of the sole, the second metatarsal region including a third plurality of rounded ridges disposed adjacent to one another and extending substantially across a width of the sole.

The configuration of the different shoes provides a pair of shoes well-suited for those who spend a substantial amount of time driving, including those who make a livelihood out of driving (e.g., race car drivers, taxi cab drivers, bus drivers and commercial truck drivers). The pair of driving shoes is particularly well-suited for those vehicles which require two or more control pedals (e.g., accelerator, brake, clutch). For example, in driving an automobile or truck having a standard transmission, the left shoe for controlling the clutch pedal includes regions configured to maintain good traction at regions which contact the clutch pedal and floorboard. The right shoe is similarly configured, but the region contacting the accelerator and brake pedal is configured differently to allow quick movement between the pedals during driving. Furthermore, although the contact regions of the outsoles of the left and right shoes are different the wearer experiences no difference in feel when walking.

Preferred embodiments of the invention may include one or more of the following features. The first metatarsal region includes wedge cutouts, each of which extends substantially in a direction transverse to a length of the rounded ridges on the first metatarsal region. On the other hand, the second metatarsal region includes wedge cutouts each of which extends substantially in a direction transverse to a length of the rounded ridges on the second metatarsal region. Each of the wedge cutouts of the second metatarsal region extends across the rounded ridges in zig- of between 5 to 50%. The rounded ridges at the heel region of the shoes are wave-shaped.

Other advantages and features of the invention will become apparent from the following description of presently preferred embodiments, and from the claims.

DESCRIPTION OF THE PREFERRED EMBODIMENTS

Figure 1:
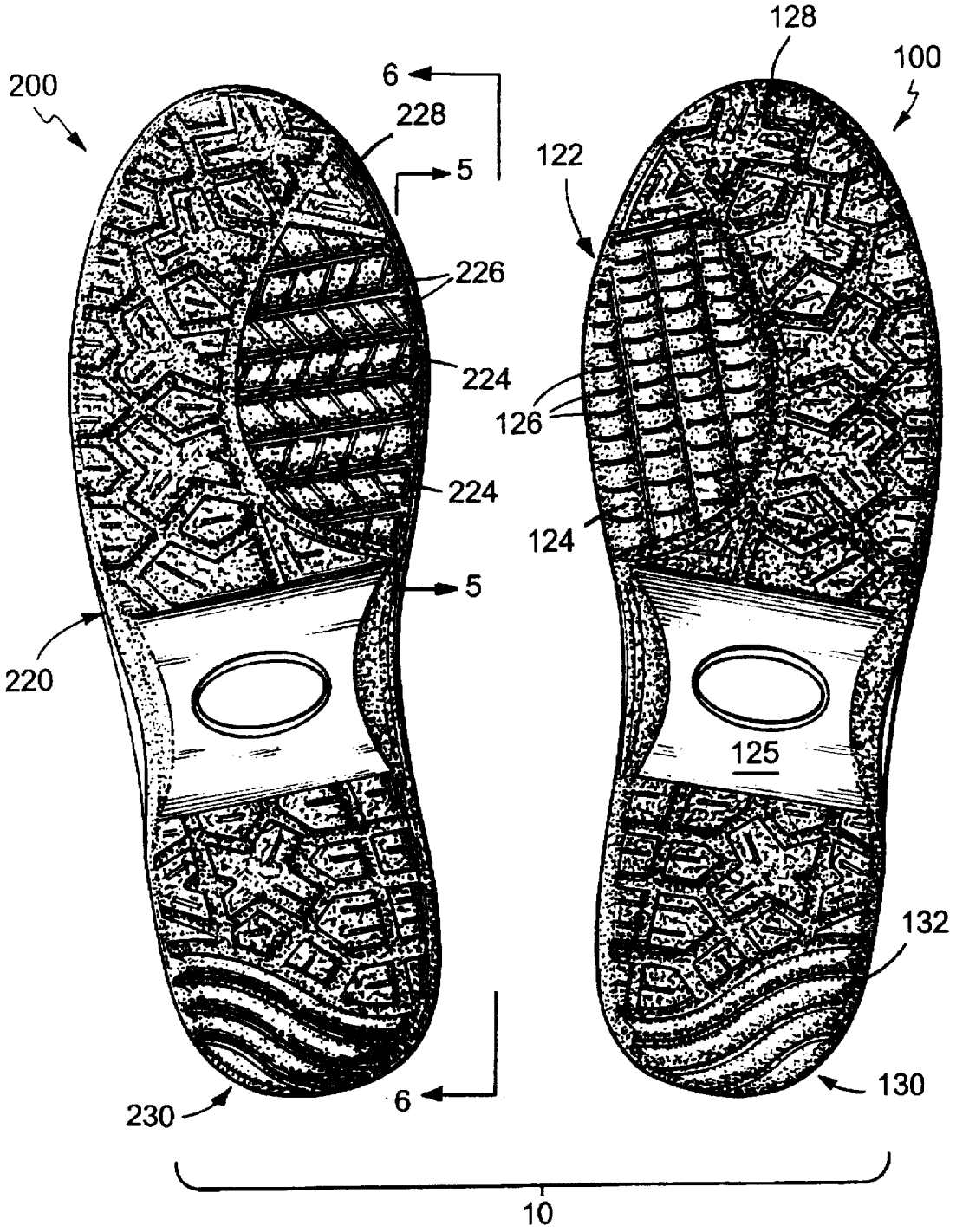
FIG. 1 is a bottom plan view of a footwear system of the invention showing the right and left soles of a shoe or boot.

Referring to FIGS. 1–5, a footwear system 10 of the invention consists of a left shoe 100 and a right shoe 200 of a pair of driving shoes. In general, each shoe 100, 200 includes a shoe upper 10 having a tongue 12 extending into a vamp portion of the upper, and eyelets 14 for receiving conventional front lacing 16. Each shoe 100, 200 further includes an outsole 120, 220, respectively, each formed of rubber, leather, plastic, or other suitable material and having a tread pattern well-suited for driving as well as walking, the outsole 120 being different from the outsole 220, as described below.

Figure 2:
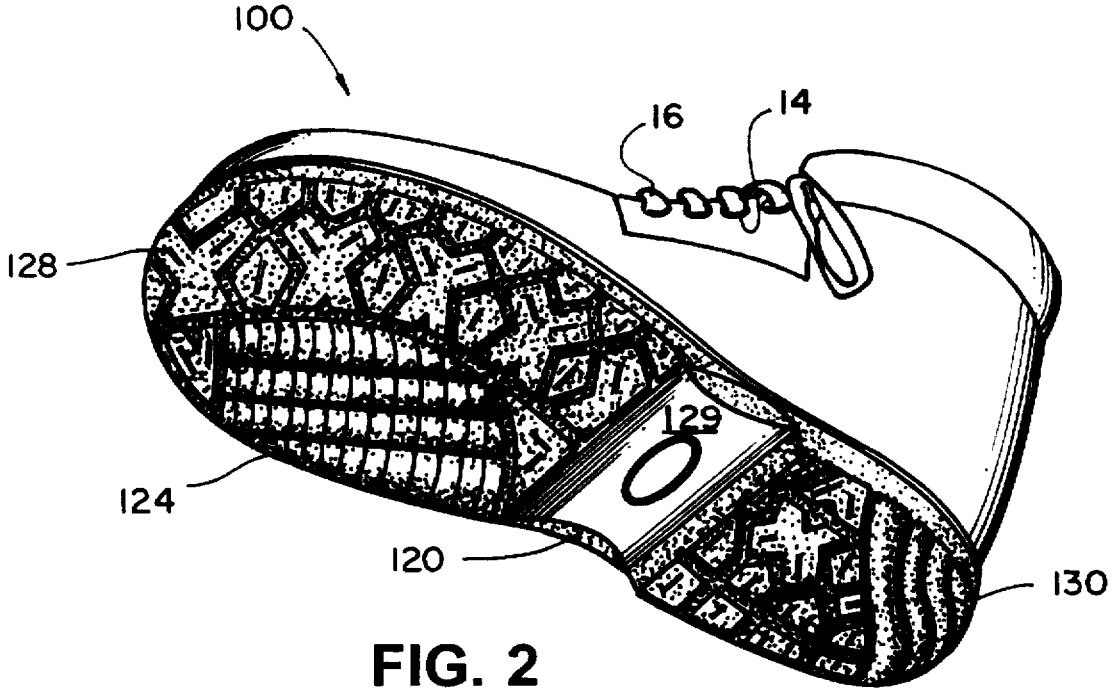
FIG. 2 is a perspective view of a left shoe of the footwear system of the invention.
Figure 3:
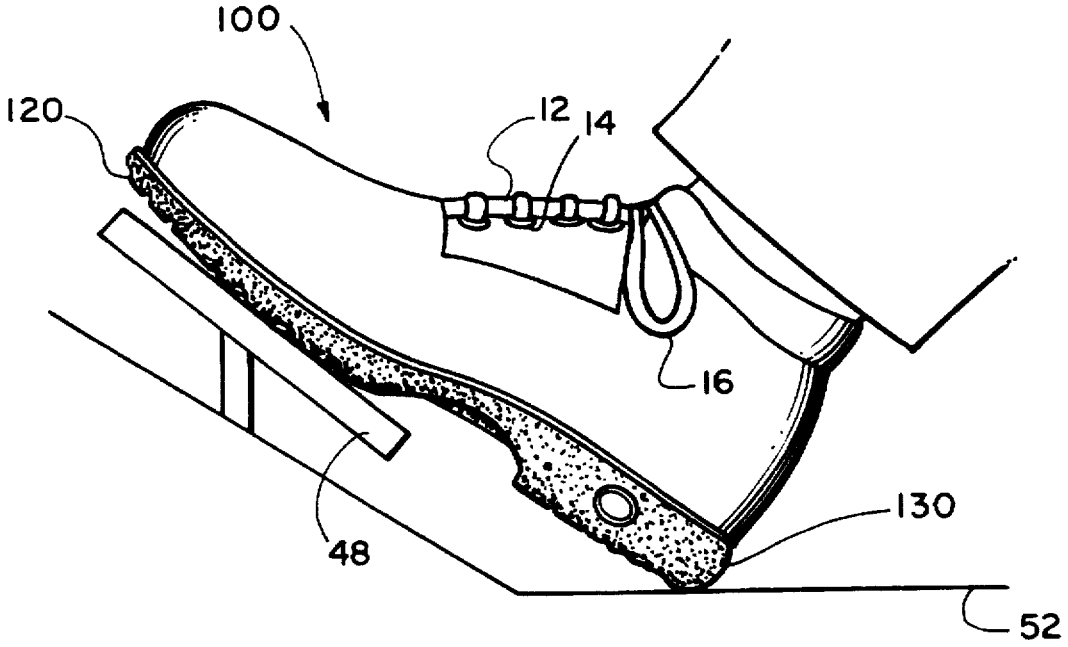
FIG. 3 is a side view of a left shoe of the footwear system in use.
Figure 4:
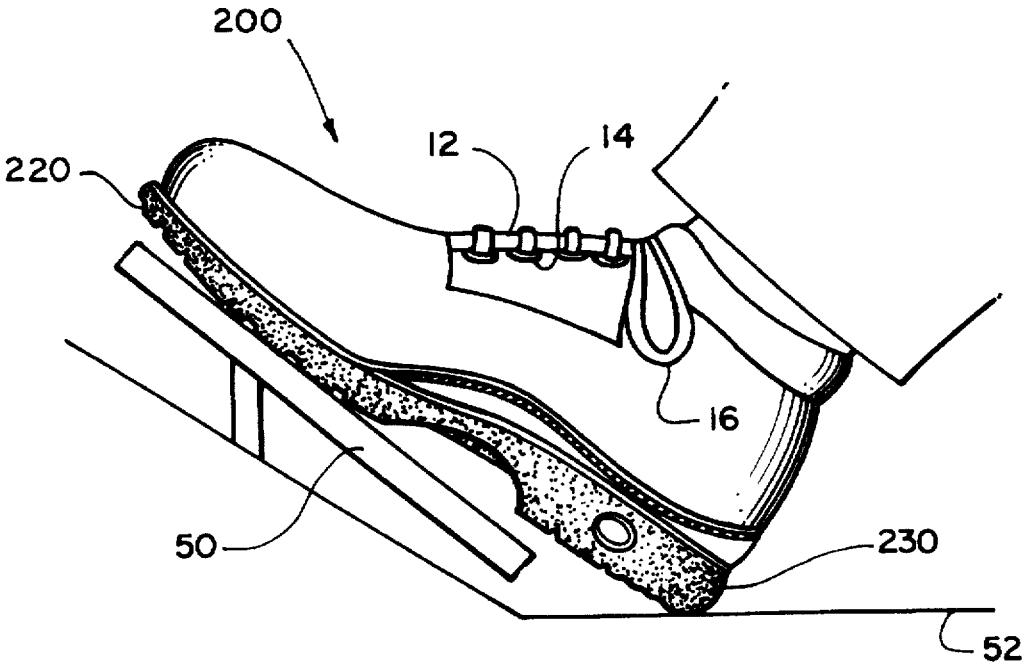
FIG. 4 is a similar view of a right shoe of the footwear system in use.
Figure 5:
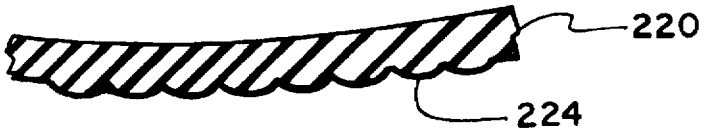
FIG. 5 is a cross-sectional side view of a portion of the right shoe taken along line 5—5 of FIG. 1.
Figure 6:
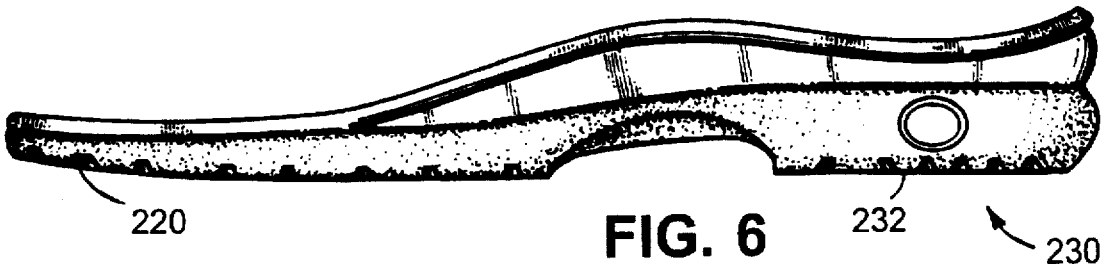
FIG. 6 is a side view of the right shoe taken along line 6—6 of FIG. 1.

Referring to FIGS. 1 and 2, left shoe 100, which is generally associated with controlling the clutch pedal, includes an outsole 120 having a metatarsal region 122 over which the ball of the wearer's foot is generally positioned when the shoe is worn. Metatarsal region 122 has a generally oblong shape extending from the inner edge of the shoe to about halfway across the width of the shoe. Metatarsal region includes a series of rounded ridges 124 arranged in parallel. Each rounded ridge has a textured, matted ("lightly sanded") surface with wedge cutouts 126 extending across the ridge and equally spaced by a distance of about 8 to 10 mm. Each rounded ridge 124 has a width of about 12 mm and a height of about 3 mm at its apex and extends substantially along the length of the shoe. In a preferred embodiment, as shown in FIG. 1, rounded ridges 124 are angularly offset slightly from the central axis of the shoe in a direction generally toward the big toe. The alignment of rounded ridges 124 along the axis of outsole 120, and the texture and shape of the rounded ridges 124, allow them the to serve as gripping members to prevent the wearer's foot from slipping from the clutch pedal 48 (FIG. 3) during driving of the vehicle.

Outsole 120 also includes a heel region 130 having rounded ridges 132 having the same general shape and size as rounded ridges 124 of metatarsal region 122. Rounded ridges 132 also have a lightly sanded texture. Unlike rounded ridges 124, however, rounded ridges 132 extend generally across the width of outsole 120 and have a "wavy" shape. The ridges formed across the width of the sole provide the wearer with good traction to the floorboard 52 (FIG. 3), while allowing the wearer's foot to pivot about the heel region.

Outsole 120 includes lugs 128 sized and shaped to provide traction during normal walking. Lugs 128 preferably have a heavier matted surface than rounded ridges 124 and 132 of metatarsal and heel regions 122, 130, respectively. Lugs 128 are formed on remaining portions of outsole 120, except for a central region 129 which is not a walking surface of the shoe and is used to provide the manufacturer's logo.

Referring to FIGS. 1 and 3–5, right shoe 200, which is generally associated with controlling the accelerator and brake clutch pedal, includes an outsole 220 which is, in essence, a mirror image of outsole 120 with one exception. Unlike outsole 120 of left shoe 100, outsole 220 of right shoe 200 includes a metatarsal region 222 having rounded ridges 224 extending across the width of outsole 220. Rounded ridges 224 have a similar size and shape as ridges 124 and include wedges 226 which extend along the length of the shoe and across each of the ridges in "zig-zag" fashion. Wedges 226 are about 1 mm wide and are spaced from each other by a distance of about 8 mm. Outsole 220 includes lugs 228, central region 229 and a heel region 230 virtually identical to that of outsole 120.

Unlike outsole 120, which is configured for use with the clutch pedal 48, the rounded ridges 224 of outsole 220 are configured to provide traction to prevent slipping off the accelerator pedal 50 (FIG. 4) or brake pedal (not shown), while simultaneously permitting the wearer's foot to move quickly from one to the other.

Although the different orientations of rounded ridges 124, 224 of outsoles 120, 220 provide left and right shoes which are different, the ridges are similar in shape and size so as to provide a pair of driving shoes which provide the same comfortable feel during walking. Although, not a requirement, shoes 100, 200 may include an optional cushioning layer between the insole of the shoe and the outsole to further promote the same comfortable feel experienced by the wearer.

Other embodiments are within the following claims. For example, although the above embodiment has been described in conjunction with a laced shoe, the invention is also applicable to other forms of shoes and other footwear, e.g., including boots, sandals and the like.

What is claimed is:

1. A footwear system for use in driving a vehicle, comprising:

a first boot or shoe and a second boot or shoe, each including a sole and an upper, said sole and upper together defining a volume for receiving a foot of a wearer, each said sole comprising:

a toe region at a distal end of the sole; and a heel region at a proximal end of the sole with a first plurality of rounded ridges disposed adjacent to one another and extending substantially across a width of the sole;

the sole of said first boot or shoe comprising a first metatarsal region disposed substantially between toe and heel regions and along an inner side of the sole, said first metatarsal region comprising a second plurality of rounded ridges disposed adjacent to one another and extending substantially along a length of the sole; and the sole of said second boot or shoe comprising a second metatarsal region disposed substantially between toe and heel regions and along an inner side of the sole, said second metatarsal region including a third plurality of rounded ridges disposed adjacent to one another and extending substantially across a width of the sole.

2. The footwear system of claim 1 wherein said first metatarsal region includes a first plurality of wedge cutouts, each extending substantially in a direction transverse to a length of said second plurality of rounded ridges.

3. The footwear system of claim 1 wherein said second metatarsal region defines a second plurality of wedge cutouts, each said cutout extending substantially in a direction transverse to a length of said third plurality of rounded ridges.

4. The footwear system of claim 3 wherein each of said second plurality of wedge cutouts extends across the third plurality of rounded ridges in zig-zag fashion.

5. The footwear system of claim 1 wherein each of said first, second and third plurality of rounded ridges has a height and a width, the ratio of height to width being in a range of between 5 to 50%.

6. The footwear system of claim 1 wherein said first plurality of rounded ridges are wave-shaped.

* * * * *